US010088798B2

(12) United States Patent
Itabashi

(10) Patent No.: US 10,088,798 B2
(45) Date of Patent: Oct. 2, 2018

(54) DEVELOPING CARTRIDGE INCLUDING TUBULAR MEMBER MOVABLE FROM FIRST POSITION TO SECOND POSITION

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 11 days.

(21) Appl. No.: 15/469,847

(22) Filed: Mar. 27, 2017

(65) Prior Publication Data

US 2018/0095411 A1 Apr. 5, 2018

(30) Foreign Application Priority Data

Sep. 30, 2016 (JP) ..... 2016-193865

(51) Int. Cl.
*G03G 15/30* (2006.01)
*G03G 21/16* (2006.01)
*G03G 15/08* (2006.01)

(52) U.S. Cl.
CPC ..... *G03G 21/1647* (2013.01); *G03G 21/1676* (2013.01); *G03G 15/0865* (2013.01)

(58) Field of Classification Search
CPC ..... G03G 21/1647; G03G 21/1676; G03G 15/0865
USPC ..... 399/149
See application file for complete search history.

(56) References Cited

U.S. PATENT DOCUMENTS

2013/0051833 A1 2/2013 Itabashi et al.
2013/0084081 A1 4/2013 Itabashi et al.

FOREIGN PATENT DOCUMENTS

JP 2006-235236 A 9/2006
JP 2009-244563 A 10/2009
JP 2013-054056 A 3/2013
JP 2013-073213 A 4/2013

OTHER PUBLICATIONS

International Search Report and Written Opinion issued in related international application No. PCT/JP2017/012329, dated May 16, 2017.

*Primary Examiner* — Walter L Lindsay, Jr.
*Assistant Examiner* — Ruth Labombard
(74) *Attorney, Agent, or Firm* — Merchant & Gould P.C.

(57) ABSTRACT

A developing cartridge includes a casing, a developing roller, a shaft, a tubular member, an elastic member, and a gear. The tubular member is rotatable about the shaft and is movable from a first position and a second position. The tubular member at the second position is farther from an outer surface of the casing in an axial direction than at the first position. The gear is rotatable about the shaft from a first rotational position to a second rotational position. In case where the gear is at the first rotational position, the gear engages with the tubular member and the tubular member is rotatable together with the gear at the first position. In a case where the gear is at the second rotational position, the engagement of the gear with the tubular member is released and the tubular member stops rotating at the second position.

15 Claims, 10 Drawing Sheets

DEVELOPING CARTRIDGE INCLUDING TUBULAR MEMBER MOVABLE FROM FIRST POSITION TO SECOND POSITION

CROSS REFERENCE TO RELATED APPLICATION

This application claims priority from Japanese Patent Application No. 2016-193865 filed Sep. 30, 2016. The entire content of the priority application is incorporated herein by reference.

TECHNICAL FIELD

The present disclosure relates to a developing cartridge.

BACKGROUND

A developing cartridge including a developing roller is known in the art. The developing cartridge is attachable to and detachable from an image forming apparatus.

Prior art discloses a developing cartridge including a gear rotatable from a first position to a second position, and a protrusion provided at the gear. The protrusion is rotatable together with the gear, and contacts a lever provided at an image forming apparatus. The lever is moved by contact with the protrusion. The image forming apparatus detects the movement of the lever to determine a specification of the developing cartridge. Further, the gear includes a toothless portion. In a case where the toothless portion faces a drive gear configured to transmit driving force to the gear, meshing engagement between the gear and the drive gear is released, thereby causing rotation of the gear to be stopped. Thus, rotation of the protrusion is also stopped.

SUMMARY

In such a conventional developing cartridge, demand has been made for stopping rotation of the protrusion by a structure other than the above described structure where the rotation of the protrusion is stopped by the disengagement between the gear and the drive gear.

It is therefore an object of the disclosure to provide a developing cartridge capable of stopping rotation of the protrusion with a structure other than the structure where the rotation of the protrusion is stopped by the disengagement between the gear and the drive gear.

In order to attain the above and other objects, according to one aspect, the disclosure provides a developing cartridge includes a casing, a developing roller, a shaft, a tubular member, an elastic member, and a gear. The casing is configured to accommodate developing agent and has an outer surface. The developing roller is rotatable about a first axis extending in an axial direction. The shaft extends in the axial direction and is positioned at the outer surface. The tubular member is rotatable about the shaft and covers a peripheral surface of the shaft. The tubular member is movable from a first position at which the tubular member is spaced away from the outer surface by a first distance to a second position at which the tubular member is spaced away from the outer surface by a second distance greater than the first distance. The tubular member includes a protrusion extending along a portion of the peripheral surface of the shaft. The elastic member is positioned between the outer surface and the tubular member. The elastic member has a first state in which the elastic member has a first length in the axial direction and a second state in which the elastic member has a second length in the axial direction. The second length is greater than the first length. One end portion of the elastic member in the axial direction is in contact with the tubular member. The tubular member is positioned at the first position in a case where the elastic member is in the first state. The tubular member is positioned at the second position in a case where the elastic member is in the second state. The gear covers a peripheral surface of the tubular member. The gear is rotatable about the shaft from a first rotational position to a second rotational position. In a case where the gear is at the first rotational position, the gear engages with the tubular member and the tubular member is rotatable together with the gear at the first position. In a case where the gear is at the second rotational position, the engagement of the gear with the tubular member is released and the tubular member stops rotating at the second position.

BRIEF DESCRIPTION OF THE DRAWINGS

The particular features and advantages of the disclosure will become apparent from the following description taken in connection with the accompanying drawings, in which.

DETAILED DESCRIPTION

First Embodiment

A developing cartridge 1 according to a first embodiment will be described while referring to FIGS. 1 through 6.

1. Outline of Developing Cartridge 1

Figure 1:
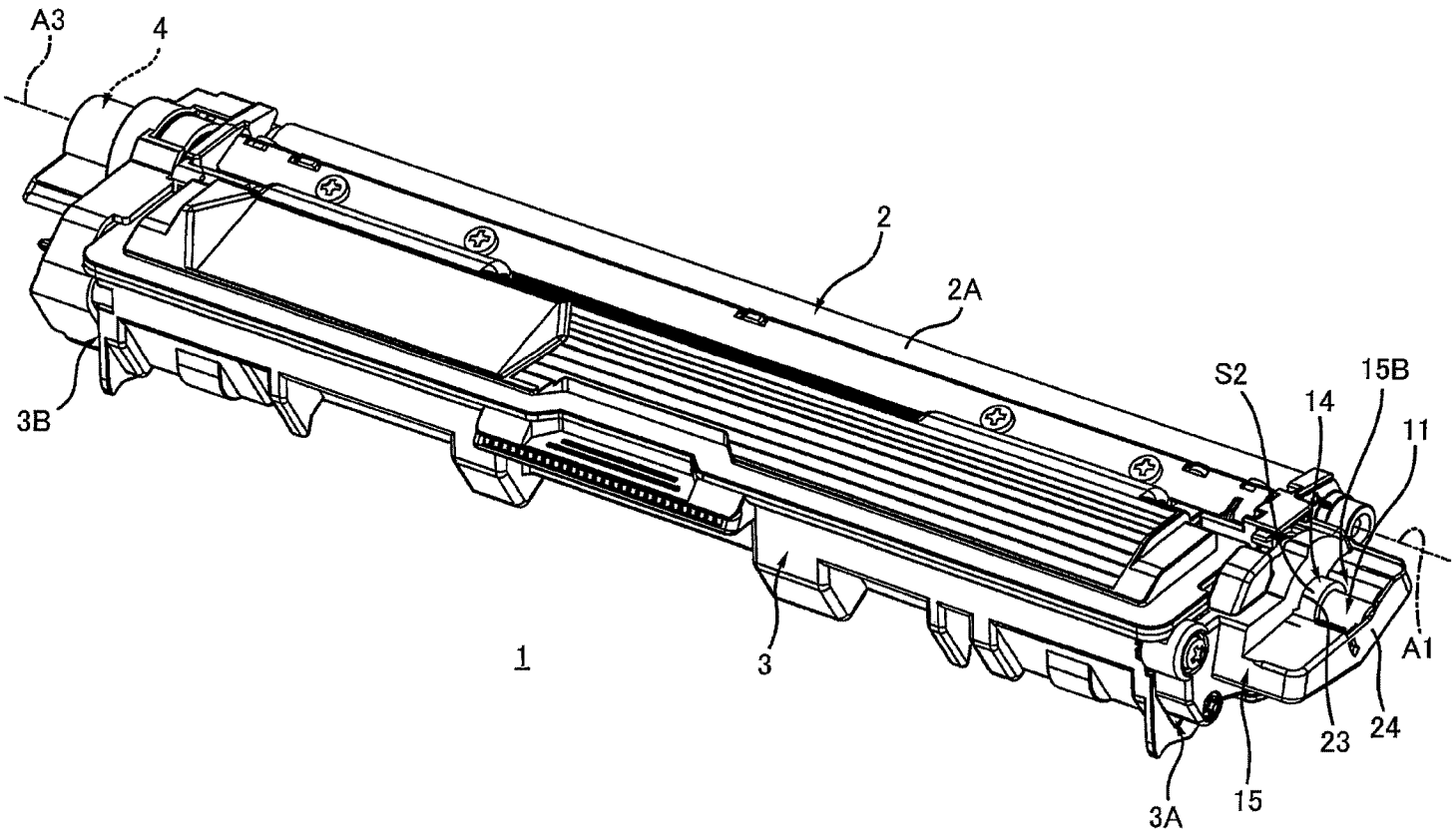
FIG. 1 is a perspective view of a developing cartridge according to a first embodiment.

An outline of the developing cartridge 1 will be described with reference to FIG. 1. The developing cartridge 1 is configured to accommodate therein developing agent. As illustrated in FIG. 1, the developing cartridge 1 includes a developing roller 2, a casing 3 and a coupling 4.

1.1 Developing Roller 2

Figure 2:
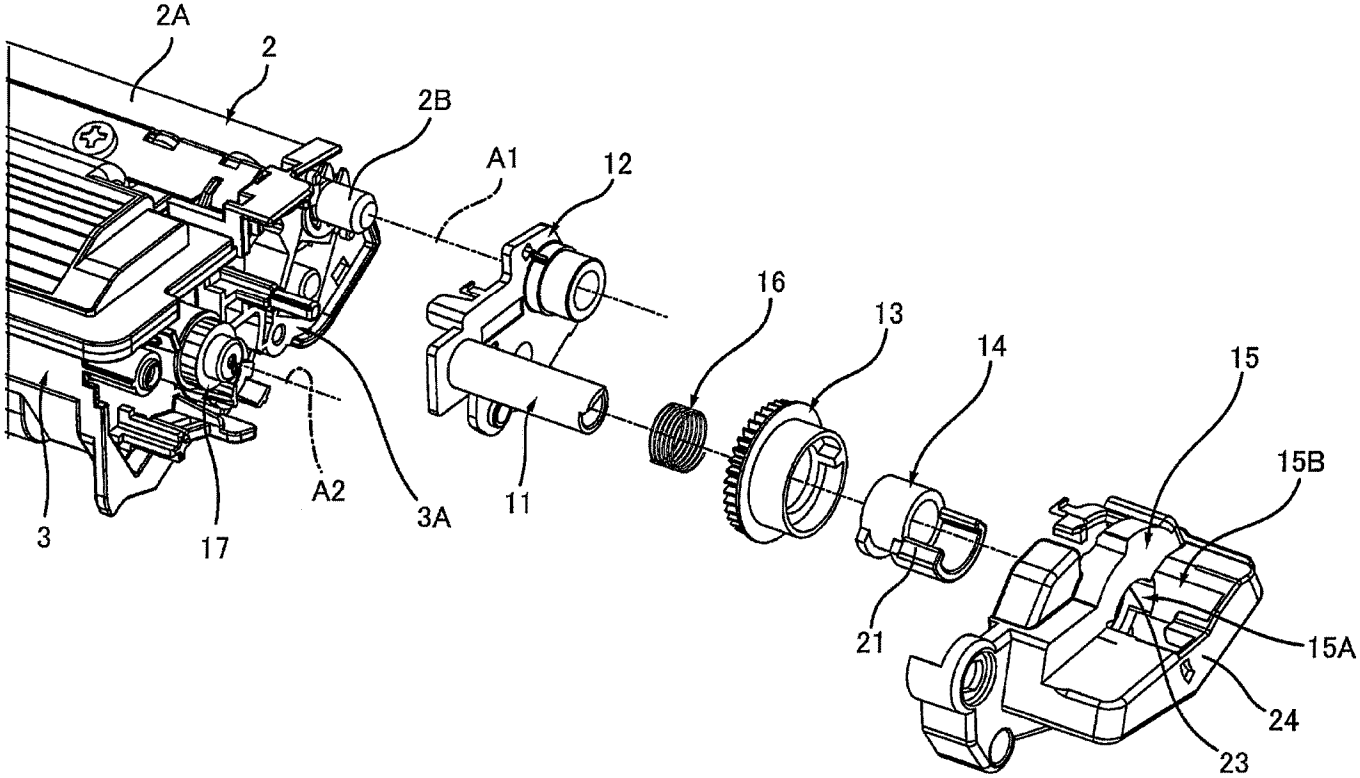
FIG. 2 is an exploded perspective view of the developing cartridge according to the first embodiment.

The developing roller 2 is rotatable about a first axis A1 extending in an axial direction of the developing roller 2. A portion of a circumferential surface of the developing roller 2 is exposed to an outside of the casing 3. The developing roller 2 includes a roller body 2A and a developing roller shaft 2B (FIG. 2). The roller body 2A extends in the axial direction and is made from electrically conductive rubber. The developing roller shaft 2B extends in the axial direction. Specifically, the developing roller shaft 2B extends along the first axis A1. The developing roller shaft 2B is made from metal.

1.2 Casing 3

The casing 3 is configured to accommodate therein developing agent such as toner. In the following description, "inside" of the casing 3 denotes a side at which the developing agent is accommodated, and "outside" of the casing 3 denotes a side opposite to the inside. The casing 3 extends in the axial direction, and has one outer surface 3A and another outer surface 3B in the axial direction. The outer surface 3B is spaced away from the outer surface 3A in the axial direction.

Incidentally, an agitator (not illustrated) is positioned inside the casing 3. The agitator is configured to agitate developing agent accommodated in the casing 3 and to supply the developing agent to the developing roller 2. The agitator is configured to agitate the developing agent accommodated in the casing 3. The agitator is rotatable about a second axis A2 (FIG. 2) extending in the axial direction. The agitator includes an agitator shaft and a blade extending from the agitator shaft. The agitator shaft extends in the axial direction. Specifically, the agitator shaft extends along the second axis A2.

1.3 Coupling 4

The coupling 4 is configured to receive driving force. The coupling 4 is positioned at the outer surface 3B. The coupling 4 is positioned opposite to a gear 13 (described later, FIG. 2) with respect to the casing 3 in the axial direction. The coupling 4 is rotatable about a third axis A3 extending in the axial direction. The driving force received in the coupling 4 is transmitted to the developing roller shaft 2B and the agitator shaft.

2. Details of Developing Cartridge 1

Details of the developing cartridge 1 will be described with reference to FIGS. 2 through 6. As illustrated in FIG. 2, the developing cartridge 1 further includes a gear 13, and a tubular member 14. As illustrated in FIGS. 4A and 5A, the tubular member 14 is moveable in the axial direction from a first position (FIG. 4A) to a second position (FIG. 5A). In a case where the tubular member 14 is at the first position, the tubular member 14 is rotatable together with the gear 13 in a state where the tubular member 14 engages with the gear 13.

Then, the tubular member 14 moves from the first position to the second position as a result of rotation of the gear 13 to a predetermined rotational position. More specifically, as a result of rotation of the gear 13 from a first rotational position (FIG. 4A) to a second rotational position (FIG. 5A), the tubular member 14 moves from the first position to the second position. In a case where the tubular member 14 is positioned at the second position, that is, in a case where the tubular member 14 moves from the first position to the second position, the engagement between the gear 13 and the tubular member 14 is released, thereby causing rotation of the tubular member 14 to be stopped. Detailed structure of the developing cartridge 1 will be described below.

As illustrated in FIG. 2, the developing cartridge 1 further includes a shaft 11, a bearing 12, a gear cover 15, an elastic member 16, and a second gear 17.

2.1 Shaft 11

The shaft 11 is positioned opposite to the coupling 4 (FIG. 1) with respect to the casing 3 in the axial direction. The shaft 11 extends in the axial direction. More specifically, the shaft 11 extends from the bearing 12 in the axial direction. The shaft 11 has a hollow cylindrical shape. The shaft 11 is positioned at the outer surface 3A of the casing 3. More specifically, the shaft 11 is positioned at the outer surface 3A of the casing 3 as a result of attachment of the bearing 12 to the outer surface 3A. The shaft 11 is made from electrically conductive resin. In the following description, the phrase "electrically conductive" denotes electro-conductivity capable of supplying developing bias to the developing roller shaft 2B. Polyacetal resin (POM) is one example of the electrically conductive resin.

2.2 Bearing 12

The bearing 12 is attached to the outer surface 3A. The developing roller shaft 2B is rotatably fitted to the bearing 12. That is, the bearing 12 receives the developing roller shaft 2B. In other words, the bearing 12 supports the developing roller shaft 2B. The bearing 12 is made from electrically conductive resin. The bearing 12 covers a circumferential surface of the developing roller shaft 2B. The bearing 12 is in contact with the circumferential surface of the developing roller shaft 2B. Therefore, the developing roller shaft 2B is electrically connected to the bearing 12. Further, the shaft 11 is electrically connected to the developing roller 2 through the bearing 12, because the shaft 11 extends from the bearing 12.

2.3 Gear 13

The gear 13 is rotatable from the first rotational position to the second rotational position. The gear 13 is positioned at the outer surface 3A. More specifically, the gear 13 is positioned opposite to the outer surface 3A with respect to the bearing 12 in the axial direction. As illustrated in FIG. 3A, the gear 13 has a through-hole 13A. The shaft 11 (FIG. 2) is inserted through the through-hole 13A, so that the gear 13 is rotatable about the shaft 11. As illustrated in FIG. 3A, the gear 13 includes a plurality of gear teeth 18, a sleeve portion 19, and a first rib 20.

The plurality of gear teeth 18 are positioned at a circumferential surface of the gear 13. More specifically, the plurality of gear teeth 18 are provided throughout the entire circumferential surface of the gear 13 in a rotational direction R of the gear 13. The plurality of gear teeth 18 are arrayed in the rotational direction R.

The sleeve portion 19 is positioned opposite to the outer surface 3A with respect to the plurality of gear teeth 18 in the axial direction. The sleeve portion 19 extends in the axial direction. The sleeve portion 19 has a hollow cylindrical shape having an inner diameter greater than an inner diameter of the through-hole 13A.

The first rib 20 is configured to be in contact with a second rib 22 (described later, FIG. 4A) of the tubular member 14 in a case where the tubular member 14 is at the first position. The first rib 20 is positioned inside the sleeve portion 19 in a radial direction of the gear 13. The first rib 20 inwardly extends in the radial direction of the gear 13 from an inner circumferential surface S1 of the sleeve portion 19. The first rib 20 also extends in the axial direction along a portion of the inner circumferential surface S1.

2.4 Tubular Member 14

As illustrated in FIG. 2, the tubular member 14 is positioned opposite to the outer surface 3A with respect to the gear 13 in the axial direction.

2.4.1 Structure of Tubular Member 14

Figure 3B:
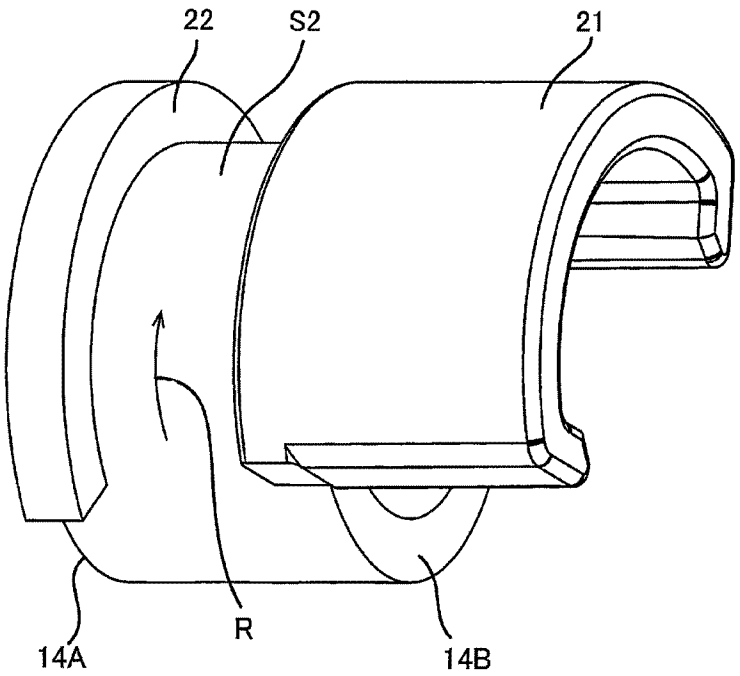
FIG. 3B is a perspective view of a tubular member illustrated in FIG. 2 in the developing cartridge according to the first embodiment.
Figure 3A:
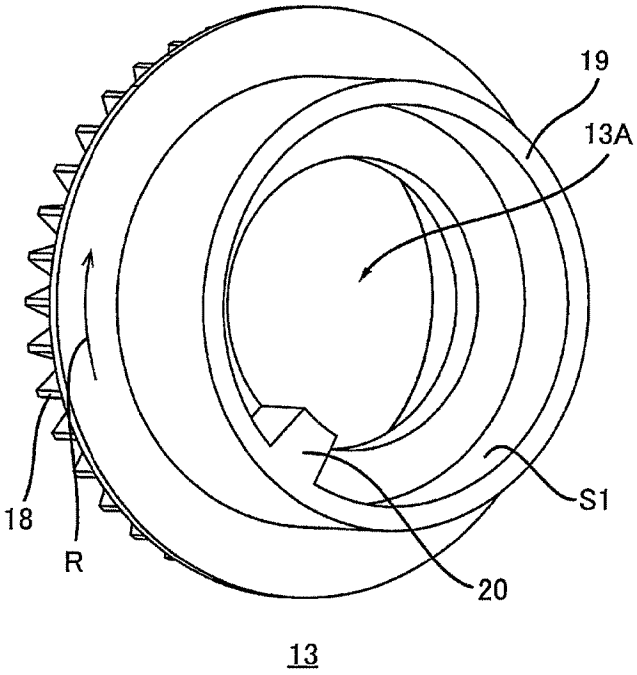
FIG. 3A is a perspective view of a gear illustrated in FIG. 2 in the developing cartridge according to the first embodiment.
Figure 4B:
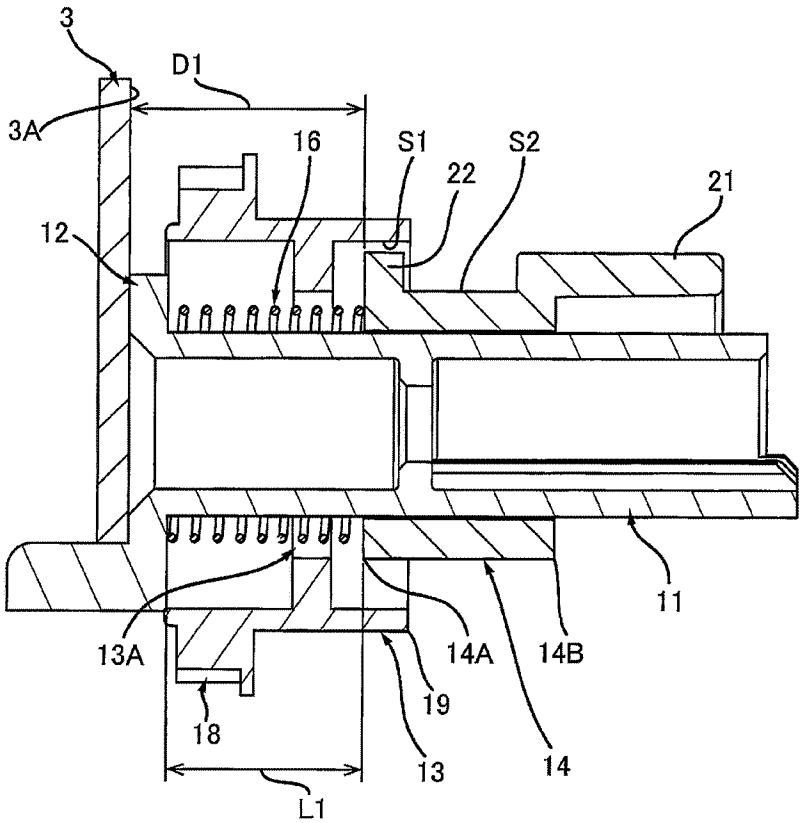
FIG. 4B is a cross-sectional view of FIG. 4A taken along a plane containing a first axis.
Figure 4A:
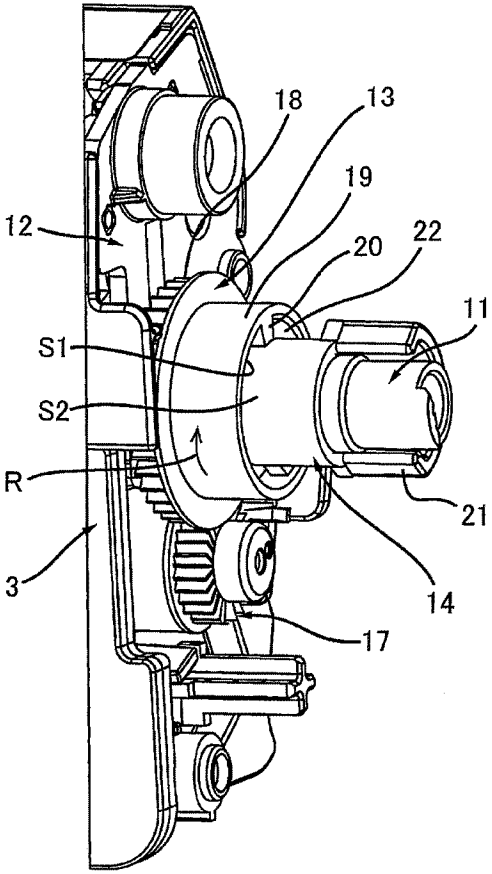
FIG. 4A is a partial perspective view of the developing cartridge according to the first embodiment for describing movement of the tubular member, and illustrating a state in which the gear is at a first rotational position and the tubular member is at a first position.

As illustrated in FIGS. 3B and 4A, the tubular member 14 extends in the axial direction. The tubular member 14 has one end portion 14A and another end portion 14B in the axial direction. The other end portion 14B is spaced away from the one end portion 14A in the axial direction. The other end portion 14B is positioned farther from the casing 3 than the one end portion 14A is from the casing 3.

The tubular member 14 has a hollow cylindrical shape. Incidentally, the shape of the tubular member 14 is not limited to the hollow cylindrical shape. Any shape is available as long as the tubular member 14 is rotatable about the shaft 11. For example, the tubular member 14 may have a hollow prismatic columnar shape having a cylindrical bore. Further, a length of the tubular member 14 in the axial direction is not limited. For example, the tubular member 14 may have a ring shape. Further, a portion of the surface portion of the tubular member 14 in the rotational direction R of the gear 13 may be notched.

The tubular member 14 is made from electrically insulative resin. The phrase "electrically insulative" denotes electrical insulating property capable of insulating developing bias. The tubular member 14 covers a peripheral surface of the shaft 11. In other words, the shaft 11 is inserted through the tubular member 14. In a state where the shaft 11 is inserted through the tubular member 14, the shaft 11 penetrates the tubular member 14. Accordingly, the tubular member 14 is rotatable about the shaft 11. Further, tubular member 14 is movable relative to the shaft 11 in the axial direction. The tubular member 14 includes a protrusion 21 and the second rib 22.

The protrusion 21 is positioned at the other end portion 14B of the tubular member 14. In other words, the protrusion 21 is positioned opposite to the outer surface 3A (FIG. 2) with respect to the tubular member 14. The protrusion 21 extends in the axial direction from the other end portion 14B of the tubular member 14. Thus, the protrusion 21 is rotatable about the shaft 11 together with the tubular member 14. Further, the protrusion 21 also extends in the rotational direction R of the gear 13. The protrusion 21 covers a portion of the peripheral surface of the shaft 11 in the rotational direction R of the gear 13.

Incidentally, in a case where the developing cartridge 1 is attached to the image forming apparatus, the protrusion 21 is configured to move a component provided at the image forming apparatus, for example. A lever is an example of the component which is moved by the tubular member 14 in the image forming apparatus. The image forming apparatus further includes an optical sensor (not illustrated) configured to detect displacement of the lever. For example, a sensor unit including a light emitting portion and a light receiving portion is used as the optical sensor. The lever includes an electrode. The electrode is configured to be in contact with the shaft 11 in a case where the developing cartridge 1 is attached to the image forming apparatus. In a case where the protrusion 21 moves the lever in the image forming apparatus, the tubular member 14 functions as a cam. More specifically, the tubular member 14 functions as the cam for moving the lever in the image forming apparatus by a peripheral surface of the protrusion 21 in a case where the tubular member 14 rotates about the shaft 11 in a state where the developing cartridge 1 is attached to the image forming apparatus.

In a case where the tubular member 14 is at the first position, the second rib 22 is configured to contact the first rib 20 and to contact a cover rib 23 (described later, FIG. 6) of the gear cover 15. The second rib 22 is positioned at the one end portion 14A of the tubular member 14. The second rib 22 protrudes outwardly in a radial direction of the tubular member 14 from an outer circumferential surface S2 of the tubular member 14. The second rib 22 extends in the rotational direction R of the gear 13. In other words, the second rib 22 extends in a circumferential direction of the tubular member 14. Further, the second rib 22 extends along a portion of the outer circumferential surface S2 in the axial direction. The second rib 22 is provided at a portion of the outer circumferential surface S2 in the rotational direction R of the gear 13.

2.4.2 Position of Tubular Member 14

As illustrated in FIGS. 4A and 5A, the tubular member 14 is movable from the first position (FIG. 4A) to the second position (FIG. 5A). The tubular member 14 is spaced away from the outer surface 3A of the casing 3 by a first distance D1 (FIG. 4B) in a case where the tubular member 14 is at the first position. The tubular member 14 is spaced away from the outer surface 3A of the casing 3 by a second distance D2 (FIG. 5B) in a case where the tubular member 14 is at the second position. The second distance D2 is greater than the first distance D1. That is, the tubular member 14 is positioned farther from the outer surface 3A of the casing 3 at the second position than at the first position.

As illustrated in FIGS. 4A and 4B, the one end portion 14A of the tubular member 14 is positioned inside the sleeve portion 19 of the gear 13 in a case where the tubular member 14 is at the first position. In this instance, the sleeve portion 19 covers a peripheral surface of the one end portion 14A of the tubular portion 14. That is, the gear 13 covers a peripheral surface of the tubular member 14. More specifically, the gear 13 has the inner circumferential surface S1 covering the peripheral surface of the tubular member 14. The inner circumferential surface S1 covers the peripheral surface of the tubular member 14.

Further, in this instance, the first rib 20 extends from the inner circumferential surface S1 in the radial direction of the gear 13 toward the outer circumferential surface S2 of the tubular member 14 as illustrated in FIG. 4A. Further, the second rib 22 extends from the outer circumferential surface S2 of the tubular member 14 in the radial direction of the gear 13 toward the inner circumferential surface S1 of the gear 13. The first rib 20 and the second rib 22 face each other in the rotational direction R of the gear 13. Therefore, the first rib 20 is brought into contact with the second rib 22 in the rotational direction R of the gear 13 by the rotation of the gear 13.

Incidentally, the first rib 20 and the second rib 22 may face each other with a gap in the rotational direction R of the gear 13 at a start timing of rotation of the gear 13. Alternatively, the first rib 20 and the second rib 22 may face and be in contact with each other in the rotational direction R of the gear 13 at the start timing of rotation of the gear 13. The gear 13 is brought into engagement with the tubular member 14 in the rotational direction R by the contact of the first rib 20 with the second rib 22. The tubular member 14 rotates together with the gear 13 in a state where the first rib 20 is in contact with the second rib 22. In other words, the tubular member 14 rotates together with the gear 13 in a state where the tubular member 14 is in engagement with the gear 13.

Rotational position of the gear 13 at which the first rib 20 is firstly brought into contact with the second rib 22 after starting rotation of the gear 13 is the first rotational position of the gear 13. In other words, rotational position of the gear 13 at which the tubular member 14 starts rotating after starting rotation of the gear 13 is the first rotational position. In a case where the gear 13 is at the first rotational position, the first rib 20 and the second rib 22 are in contact with each other and the tubular member 14 is rotatable together with the gear 13 at the first position. In other words, in a case where the gear 13 is at the first rotational position, the gear 13 and the tubular member 14 are in engagement with each other and the tubular member 14 is rotatable together with the gear 13 at the first position.

Figure 5B:
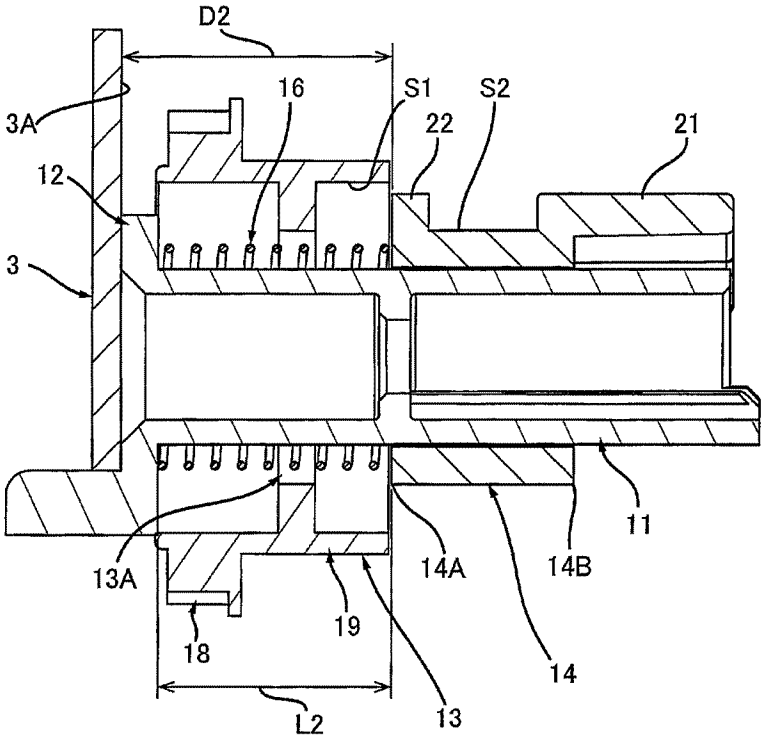
FIG. 5B is a cross-sectional view of FIG. 5A taken along a plane containing the first axis.
Figure 5A:
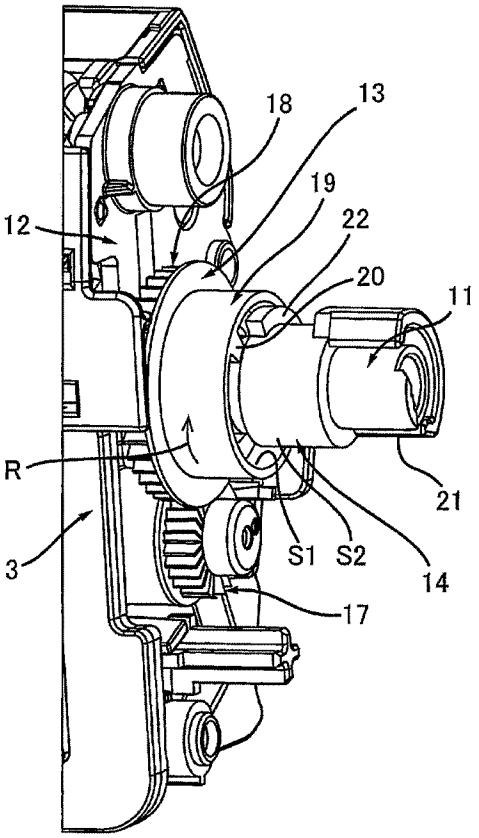
FIG. 5A is a partial perspective view of the developing cartridge according to the first embodiment for describing the movement of the tubular member in cooperation with FIG. 4A, and illustrating a state in which the gear is at a second rotational position and the tubular member is at a second position.

The tubular member 14 is positioned at the second position in a case where the gear 13 rotates from the first rotational position to the second rotational position as illustrated in FIGS. 5A and 5B. A structure for moving the tubular member 14 from the first position to the second position, and a structure for positioning the tubular member 14 at the first position and the second position will be described later. In a case where the tubular member 14 is at the second position, the one end portion 14A of the tubular member 14 is positioned opposite to the casing 3 with respect to the sleeve portion 19 of the gear 13 in the axial direction. Further, in a case where the tubular member 14 is at the second position, the second rib 22 is positioned opposite to the casing 3 with respect to the first rib 20 in the axial direction, and the first rib 20 and the second rib 22 do not face each other in the rotational direction R of the gear 13. That is, in a case where the tubular member 14 is at the second position, the contact between the first rib 20 and the second rib 22 in the rotational direction R of the gear 13 is released. In other words, engagement between the gear 13 and the tubular member 14 in the rotational direction R of the gear 13 is released. Accordingly, in a state where the tubular member 14 is at the second position, the tubular member 14 does not rotate even when the gear 13 further rotates.

Rotational position of the gear 13 at which the engagement between the first rib 20 and the second rib 22 is released after starting rotation of the gear 13 is the second rotational position of the gear 13. In other words, rotational position of the gear 13 at which the rotation of the tubular member 14 is stopped after starting rotation of the gear 13 is the second rotational position of the gear 13. In a case where the gear 13 is at the second rotational position, the contact of the first rib 20 with the second rib 22 is released (i.e., the first rib 20 and the second rib 22 are separated from each other), so that the rotation of the tubular member 14 is stopped at the second position. In other words, in a case where the gear 13 is at the second rotational position, the engagement of the gear 13 with the tubular member 14 is released, so that the rotation of the tubular member 14 is stopped at the second position.

2.5 Gear Cover 15

As illustrated in FIGS. 1 and 2, the gear cover 15 is attached to the outer surface 3A of the casing 3. The gear cover 15 covers at least a portion of the gear 13 and the second gear 17.

Further, the gear cover 15 has an insertion hole 15A and an opening 15B. The shaft 11 and the tubular member 14 are inserted into the insertion hole 15A. A portion of the shaft 11 and a portion of the tubular member 14 are exposed to the outside through the opening 15B. The protrusion 21 of the tubular member 14 moves past the opening 15B during rotation of the gear 13 from the first rotational position to the second rotational position. Incidentally, in a case where the gear 13 is at the first rotational position, the protrusion 21 is positioned in the gear cover 15 and the shaft 11 is exposed to the outside through the opening 15B. Also, in a case where the gear 13 is at the second rotational position, the protrusion 21 is positioned in the gear cover 15 and the shaft 11 is exposed to the outside through the opening 15B.

Figure 6:
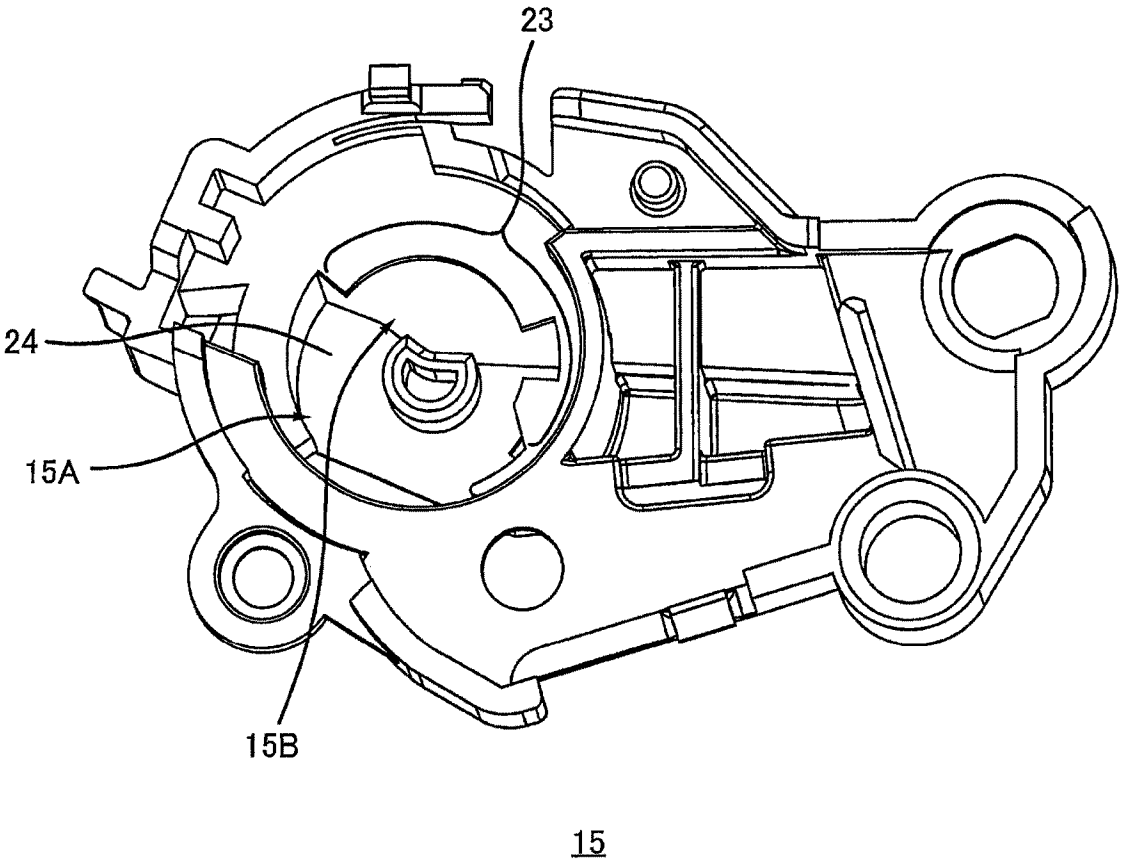
FIG. 6 is a perspective view of a gear cover illustrated in FIG. 2 in the developing cartridge according to the first embodiment, and illustrates an interior of the gear cover.

The gear cover 15 is configured to position the tubular member 14 at the first position in a case where the gear 13 is at the first rotational position. Further, the gear cover 15 is further configured to position the tubular member 14 at the second position in a case where the gear 13 is at the second rotational position. More specifically, the gear cover 15 includes the cover rib 23 and a side cover 24 as illustrated in FIGS. 1 and 6.

The cover rib 23 is configured to position the tubular member 14 at the first position in a case where the gear 13 is at the first rotational position. The cover rib 23 is provided at an open end of the insertion hole 15A. The cover rib 23 protrudes inwardly in a radial direction of the insertion hole 15A from the open end of the insertion hole 15A. In other words, the cover rib 23 protrudes in the radial direction of the tubular member 14 from the open end of the insertion hole 15A toward the outer circumferential surface S2 of the tubular member 14. The cover rib 23 extends in a rotational direction of the tubular member 14. In other words, the cover rib 23 extends in the circumferential direction of the tubular member 14. The cover rib 23 is provided at a portion of the open end of the insertion hole 15A in the rotational direction R of the gear 13.

In a case where the gear 13 is at the first rotational position, the cover rib 23 of the gear cover 23 is in contact with the second rib 22 (FIG. 4A) in the axial direction. That is, in a case where the gear 13 is at the first rotational position, the second rib 22 and a portion of the gear cover 23 are in contact with each other in the axial direction. Incidentally, in this instance, the second rib 22 of the tubular member 14 is positioned closer to the casing 3 than the cover rib 23 is to the casing 3. Thus, the tubular member 14 is subjected to positioning at the first position.

Further, in a case where the gear 13 is at the second rotational position, the second rib 22 (FIG. 5A) is positioned in the insertion hole 15A without being in contact with the cover rib 23. That is, in a case where the gear 13 is at the second rotational position, the second rib 22 and the portion of the gear cover 15 are not in contact with each other. In other words, in a case where the gear 13 is at the second rotational position, the second rib 22 and the portion of the gear cover 15 are separated from each other. More specifically, in a case where the gear 13 is at the second rotational position, the second rib 22 is offset from the cover rib 23 as viewed in the axial direction, and is separated from the cover rib 23. This state allows the tubular member 14 to move from the first position to the second position.

The side cover 24 is configured to position the tubular member 14 at the second position in a case where the gear 13 is at the second rotational position. The side cover 24 is positioned opposite to the casing 3 with respect to the opening 15B in the axial direction. The side cover 24 faces the tubular member 14 in the axial direction. In a case where the gear 13 is at the first rotational position, the protrusion 21 (FIG. 4A) of the tubular member 14 is spaced away from the side cover 24 in the axial direction. In a case where the gear 13 is at the second rotational position, the protrusion 21 (FIG. 5A) is in contact with the side cover 24 in the axial direction. Therefore, the tubular member 14 is subjected to positioning at the second position.

2.6 Elastic Member 16

As illustrated in FIGS. 4B and 5B, the elastic member 16 is positioned between the outer surface 3A and the tubular member 14 in the axial direction. More specifically, the elastic member 16 is positioned between the bearing 12 and the one end portion 14A of the tubular member 14 in the axial direction, and covers the peripheral surface of the shaft 11. Further, the elastic member 16 is positioned in the through-hole 13A of the gear 13. The elastic member 16 is positioned between the plurality of gear teeth 18 and the shaft 11 in a radial direction of the shaft 11. In other words, the elastic member 16 is positioned between the inner circumferential surface S1 of the gear 13 and the shaft 11 in the radial direction of the shaft 11. That is, the gear 13 covers both the peripheral surface of the tubular member 14 and a peripheral surface of the elastic member 16.

The elastic member 16 extends in the axial direction, and has one end portion and another end portion in the axial direction. The other end portion of the elastic member 16 is spaced away from the one end portion of the elastic member 16 in the axial direction. The one end portion of the elastic member 16 is in contact with the one end portion 14A of the tubular member 14. More specifically, the one end portion of the elastic member 16 in the axial direction is in contact with the tubular member 14 in a state where the gear 13 covers both the peripheral surface of the tubular member 14 and the peripheral surface of the elastic member 16. Incidentally, the one end portion of the elastic member 16 in the axial direction is in direct contact with the tubular member 14. Alternatively, the one end portion of the elastic member 16 in the axial direction may be in contact with the tubular member 14 through an intervening member.

The other end portion of the elastic member 16 is in contact with the bearing 12. More specifically, the other end portion of the elastic member 16 in the axial direction is in contact with the bearing 12 in a state where the gear 13 covers both the peripheral surface of the tubular member 14 and the peripheral surface of the elastic member 16. Incidentally, the other end portion of the elastic member 16 in the axial direction is in direct contact with the bearing 12. Alternatively, the other end portion of the elastic member 16 in the axial direction may be in contact with the bearing 12 through an intervening member.

According to the first embodiment, the one end portion of the elastic member 16 in the axial direction is in contact with the tubular member 14 and the other end portion of the elastic member 16 in the axial direction is in contact with the bearing 12 in a state where the gear 13 covers both the peripheral surface of the tubular member 14 and the peripheral surface of the elastic member 16. This structure provides efficient layout of the gear 13, the tubular member 14 and the elastic member 16 in comparison with a structure in which the elastic member 16 is in contact with both the gear 13 and the tubular member 14. Therefore, a size of the developing cartridge 1 in the axial direction can be reduced.

The elastic member 16 has a first state as illustrated in FIG. 4B and a second state as illustrated in FIG. 5B. More specifically, the elastic member 16 is changeable between the first state and the second state by elastic deformation. The elastic member 16 in the first state has a first length L1 in the axial direction. The elastic member 16 in the second state has a second length L2 in the axial direction. The second length L2 is greater than the first length L1. The elastic force in the axial direction of the elastic member 16 in the first state is greater than the elastic force in the axial direction of the elastic member 16 in the second state. That is, the urging force of the elastic member 16 applied to the tubular member 14 in the first state is greater than the urging force of the elastic member 16 in the second state.

In a case where the elastic member 31 is in the first state, the tubular member 14 is at the first position. Therefore, in a case where the tubular member 14 is at the first position, the tubular member 14 is urged by the elastic member 16 toward the second position.

Further, in a case where the elastic member 31 is in the second state, the tubular member 14 is at the second position. In a case where the tubular member 14 is at the second position, urging the tubular member 14 by the elastic member 16 is not a requisite factor. A coil spring is one example of the elastic member 16. However, any kind of elastic component is used as the elastic member 16 as long as the elastic member 16 can expand in the axial direction from an axially contracted state by elastic restoring force. Sponge and rubber may also be employed as the elastic member 16.

2.7 Second Gear 17

As illustrated in FIG. 2, the second gear 17 is positioned at the outer surface 3A as a result of attachment of the second gear 17 to the agitator shaft. The second gear 17 is mounted to the agitator. The second gear 17 is rotatable together with the agitator. Accordingly, driving force received in the coupling 4 (FIG. 1) is transmitted to the agitator shaft, thereby causing the second gear 17 to rotate. Further, the second gear 17 is in meshing engagement with the gear 13. Thus, the gear 13 rotates in accordance with the rotation of the second gear 17. That is, the gear 13 and the second gear 17 are rotatable by the driving force received in the coupling 4.

3. Operation in Developing Cartridge 1

Operation in the developing cartridge 1 will be described with reference to FIGS. 4A and 5A.

Upon attachment of the developing cartridge 1 to the image forming apparatus, the electrode provided at the lever is brought into contact with the shaft 11 (FIG. 1) through the opening 15B of the gear cover 15. Then, developing bias is applied to the shaft 11 from the electrode of the image forming apparatus.

In a case where the coupling 4 receives driving force from the image forming apparatus in a state where the developing cartridge 1 is attached to the image forming apparatus, the gear 13 starts rotating from the first rotational position (FIG. 4A) toward the second rotational position (FIG. 5A) by the driving force received by the coupling 4 (FIG. 1).

Then, as illustrated in FIG. 4A, since the gear 13 engages with the tubular member 14 in a case where the tubular member 14 is at the first position, the tubular member 14 rotates together with the gear 13 Therefore, the protrusion 21 is rotatable about the shaft 11.

In this case, the protrusion 21 moves to the inside of the gear cover 15, after the protrusion 21 passes through the opening 15B (FIG. 1) and goes out of the gear cover 15. In a case where the protrusion 21 moves past the opening 15B, the protrusion 21 passes through a portion between the shaft 11 and the lever of the image forming apparatus, thereby causing the electrode of the image forming apparatus to be separated from the shaft 11.

More specifically, in a case where the protrusion 21 moves past the opening 15B, the protrusion 21 is brought into contact with the lever of the image forming apparatus to displace the lever, and the optical sensor detects the displacement of the lever. In this way, since the optical sensor detects the displacement of the lever, the image forming apparatus can retrieve information about the developing cartridge 1 on the basis of the displacement of the lever. For example, in a case where the image forming apparatus determines that the optical sensor detects the displacement of the lever, the image forming apparatus determines that the attached developing cartridge 1 is a new cartridge.

In a case where the gear 13 rotates to reach the second rotational position as illustrated in FIG. 5A after the protrusion 21 moves into the gear cover 15, the tubular member 14 is moved from the first position to the second position by the urging force of the elastic member 16 as illustrated in FIG. 5B.

Then, the rotation of the tubular member 14 is stopped by disengagement between the gear 13 and the tubular member 14.

Incidentally, the gear 13 is still rotatable by the driving force received by the coupling 4 after the rotation of the tubular member 14 is stopped.

Further, in a case where the tubular member 14 has already been positioned at the second position in a case where the developing cartridge 1 is attached to the image forming apparatus, the tubular member 14 does not rotate even when the gear 13 is rotated by the driving force received by the coupling 4.

In a case where the rotation of the tubular member 14 is stopped after the protrusion 21 moves to the inside of the gear cover 15, the electrode of the image forming apparatus is brought into contact with the shaft 11, so that the developing bias is applied to the shaft 11 from the electrode of the image forming apparatus.

On the other hand, in a case where the tubular member 14 has already been positioned at the second position in a case where the developing cartridge 1 is attached to the image forming apparatus, the electrode of the image forming apparatus is not separated from the shaft 11 because the tubular member 14 does not rotate. More specifically, the optical sensor does not detect displacement of the lever. For example, in a case where the image forming apparatus determines that the optical sensor does not detect displacement of the lever, the image forming apparatus determines that the attached developing cartridge 1 is a used cartridge.

Incidentally, information indicative of whether the developing cartridge 1 is a new cartridge or used cartridge is an example of the information about the developing cartridge 1. Further, the image forming apparatus may specify the printable numbers of sheets by the developing cartridge 1 or may specify numbers of dots printable by the developing cartridge on the basis of how many times the optical sensor detects the displacement of the lever or a period of time during which the optical sensor detects the displacement of the lever.

4. Function and Effect

In the developing cartridge 1, as illustrated in FIGS. 4A and 4B, the tubular member 14 can be rotated together with the gear 13 by the engagement of the tubular member 14 with the gear 13 in a case where the tubular member 14 is at the first position.

Further, as illustrated in FIGS. 5A and 5B, in a case where the gear 13 rotates to reach the second rotational position, the rotation of the tubular member 14 can be stopped by the disengagement of the tubular member 14 from the gear 13 as a result of movement of the tubular member 14 from the first position to the second position by the elastic member 16.

Consequently, the rotation of the protrusion 21 can be stopped without releasing the meshing engagement between the gear 13 and the second gear 17 that transmits driving force to the gear 13.

Second Embodiment

A developing cartridge 100 according to a second embodiment will next be described with reference to FIGS. 7 through 10B wherein like parts and components are designated by the same reference numerals as those illustrated in the first embodiment.

1. Tubular Member 101

Figure 7:
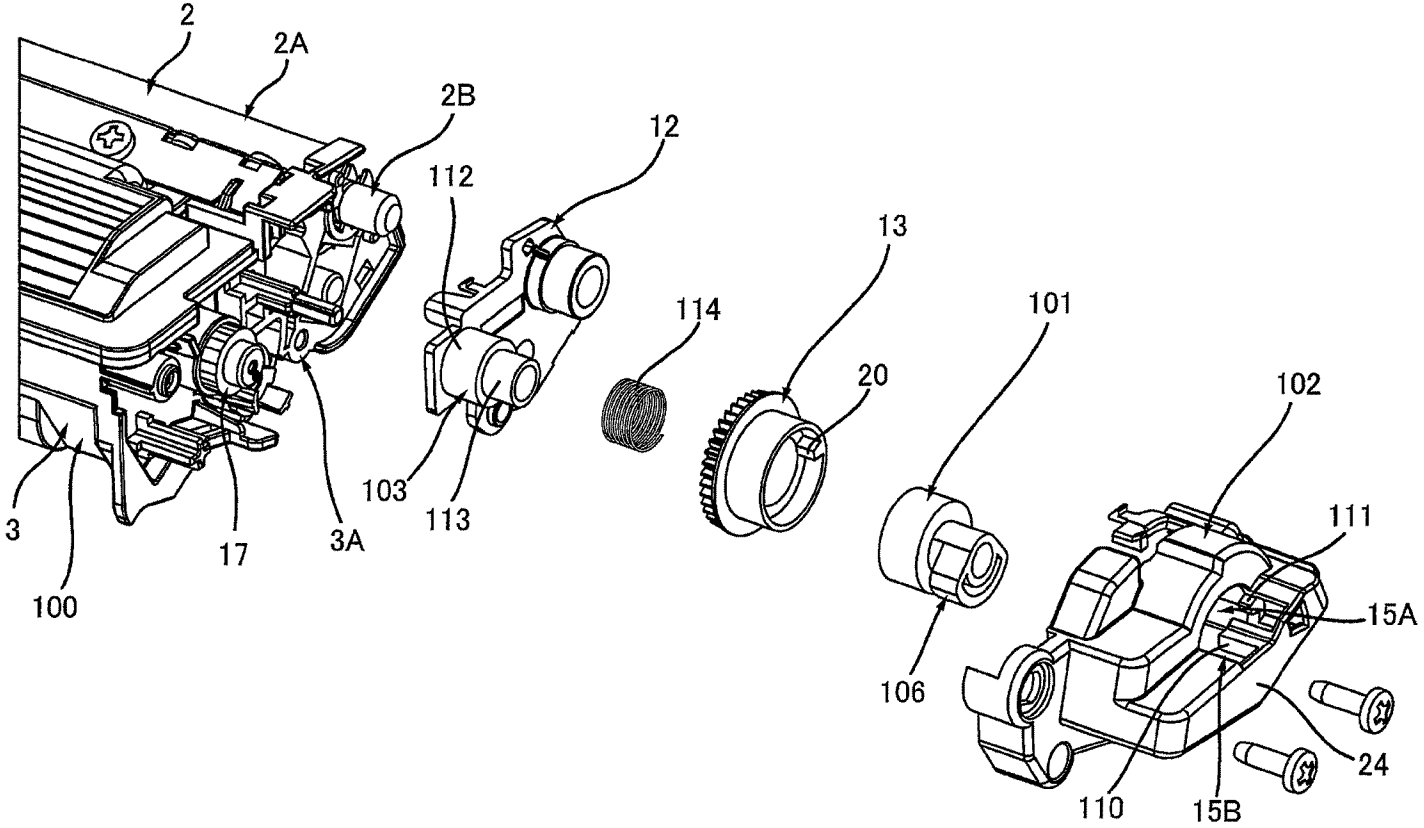
FIG. 7 is an exploded perspective view of a developing cartridge according to a second embodiment.

As illustrated in FIG. 7, a tubular member 101 is positioned opposite to the outer surface 3A with respect to the gear 13 in the axial direction, similarly to the tubular member 14 in the first embodiment.

Figure 9B:
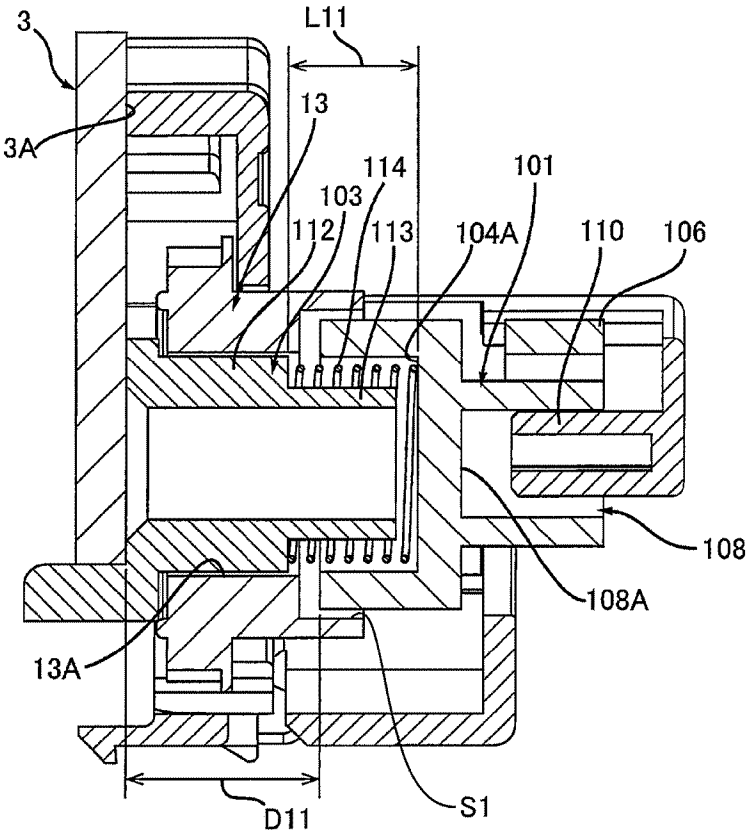
FIG. 9B is a cross-sectional view of FIG. 9A taken along a plane containing a first axis.
Figure 9A:
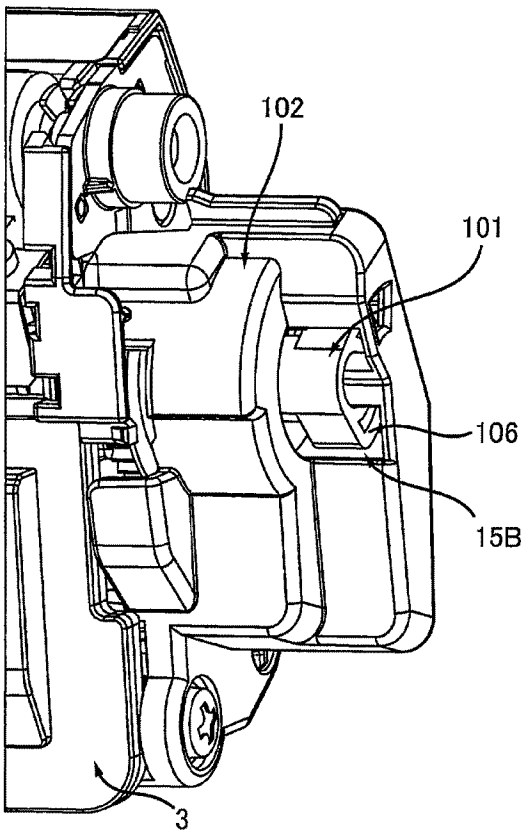
FIG. 9A is a partial perspective view of the developing cartridge according to the second embodiment for describing movement of the tubular member, and illustrating a state in which the gear is at a first rotational position and the tubular member is at a first position.
Figure 10B:
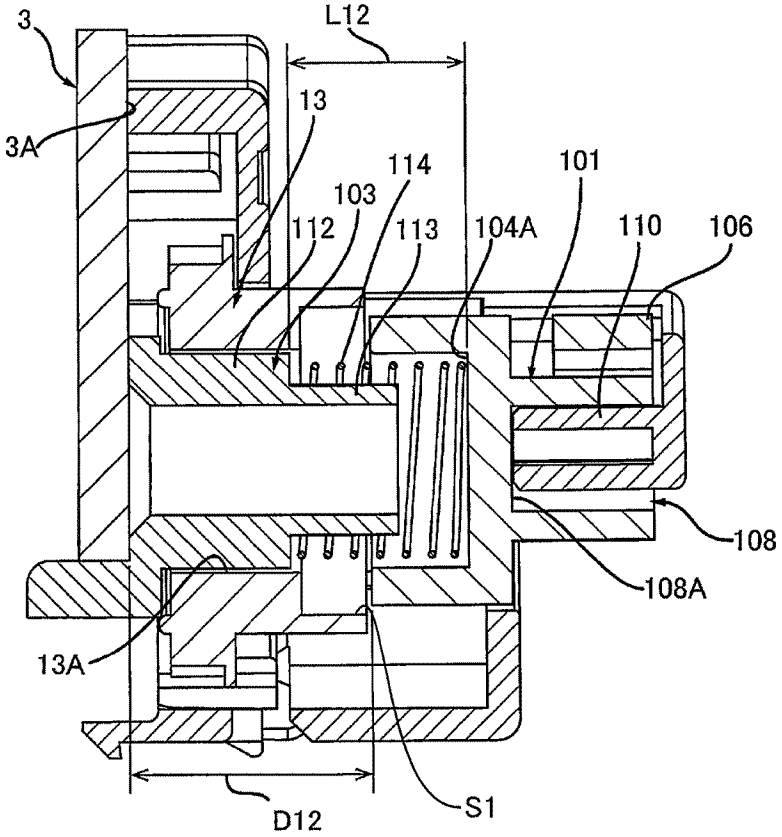
FIG. 10B is a cross-sectional view of FIG. 10A taken along a plane containing the first axis.
Figure 10A:
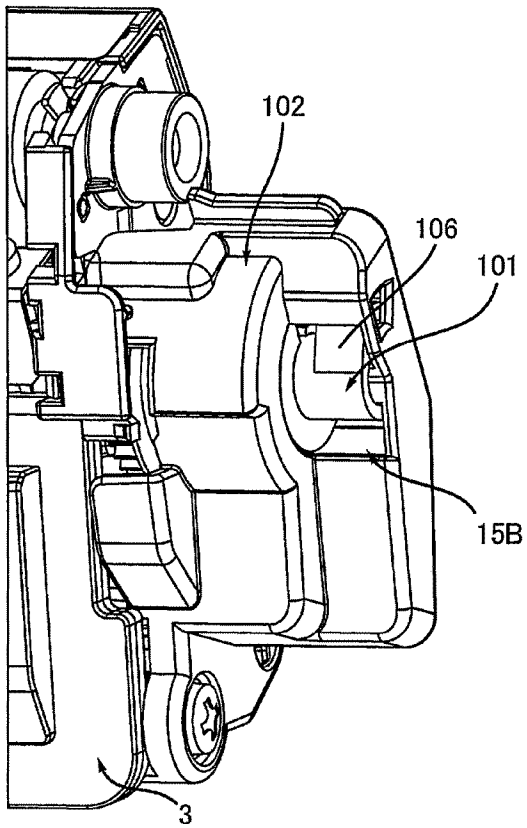
FIG. 10A is a partial perspective view of the developing cartridge according to the second embodiment for describing the movement of the tubular member in cooperation with FIG. 9A, and illustrating a state in which the gear is at a second rotational position and the tubular member is at a second position.

Further, the tubular member 101 is movable from a first position (FIG. 9A) to a second position (FIG. 10A). The tubular member 101 is spaced away from the outer surface 3A by a first distance D11 (FIG. 9B) when the tubular member 101 is at the first position. Further, the tubular member 101 is spaced away from the outer surface 3A by a second distance D12 (FIG. 10B) in a case where the tubular member 101 is at the second position. The second distance D12 is greater than the first distance D11. That is, the tubular member 101 is positioned farther from the outer surface 3A of the casing 3 at the second position than at the first position.

Figure 8A:
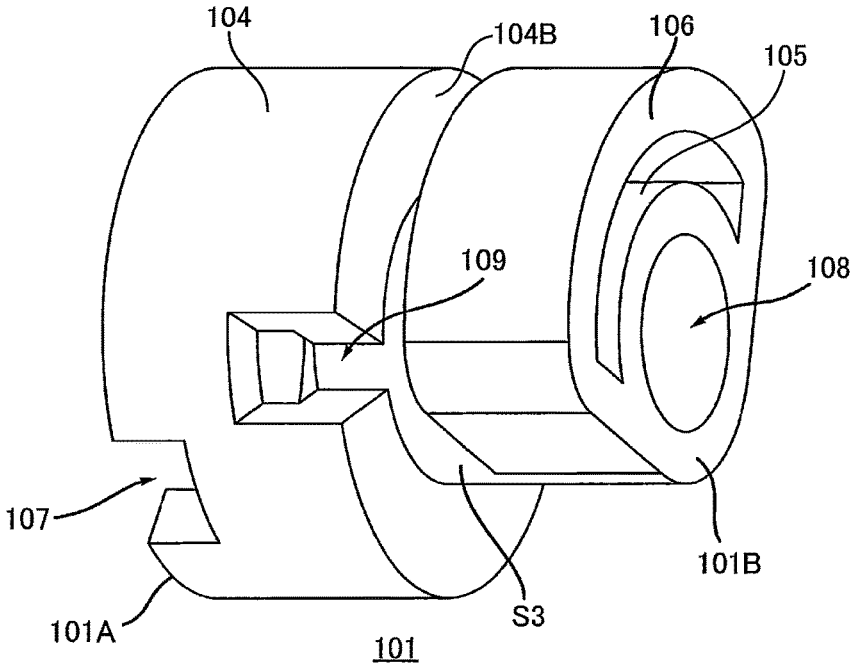
FIG. 8A is a perspective view of a tubular member illustrated in FIG. 7 in the developing cartridge according to the second embodiment.

Further, the tubular member 101 extends in the axial direction as illustrated in FIGS. 7 and 8A. The tubular member 101 has one end portion 101A and another end portion 101B in the axial direction. The other end portion 101B is spaced away from the one end portion 101A in the axial direction. The other end portion 101B is farther from the outer surface 3A than the one end portion 101A is from the outer surface 3A. The tubular member 101 is made from electrically conductive resin. As illustrated in FIG. 9B, a shaft 103 (described later) and an elastic member 114 (described later) are inserted into the one end portion 101A of the tubular member 101.

More specifically, the one end portion 101A has a recessed portion. The recessed portion is recessed from the one end portion 101A toward the other end portion 101B of the tubular member 101. The recessed portion has an inner surface 104A extending in a radial direction of the tubular member 101. The elastic member 114 is in contact with the inner surface 104A.

The tubular member 101 is configured to be in contact with a fourth rib 111 (described later, FIG. 8B) of a gear cover 102 (described later) in the axial direction in a case where the tubular member 101 is at the first position. As illustrated in FIGS. 7 and 8A, the other end portion 101B is positioned opposite to the casing 3 with respect to the one end portion 101A in the axial direction. Further, as illustrated in FIG. 8A, the tubular member 101 includes a large diameter portion 104, a small diameter portion 105, a protrusion 106, a first recessed portion 107, a second recessed portion 108, and a third recessed portion 109. The large diameter portion 104 is the one end portion 101A, and the small diameter portion 105 is the other end portion 101B.

The protrusion 106 is positioned at the other end portion 101B, and extends from an outer circumferential surface S3 of the tubular member 101. More specifically, the protrusion 106 protrudes outwardly in the radial direction of the tubular member 101 from the outer circumferential surface S3 of the small diameter portion 105. Further, the protrusion 106 extends in the rotational direction R of the gear 13. The protrusion 106 is provided at a portion of the outer circumferential surface S3 in the rotational direction R of the gear 13. The protrusion 106 passes through the opening 15B during rotation of the gear 13 from the first rotational position to the second rotational position. Incidentally, in a case where the gear 13 is at the first rotational position, a portion of the other end portion 101B is exposed to the outside through the opening 15B and the protrusion 106 is positioned in the gear cover 102 as illustrated in FIG. 9A. Also, when the gear 13 is at the second rotational position, the portion of the other end portion 101B is exposed to the outside through the opening 15B and the protrusion 106 is positioned in the gear cover 102 as illustrated in FIG. 10A.

As illustrated in FIG. 8A, the first recessed portion 107 is positioned at the one end portion 101A. The first recessed portion 107 is recessed from the one end portion 101A toward the other end portion 101B. The first recessed portion 107 is engageable with the first rib 20 (FIG. 7) of the gear 13 in a case where the tubular member 101 is at the first position. More specifically, the first rib 20 is fitted in the first recessed portion 107 in a case where the tubular member 101 is at the first position. Accordingly, in a case where the gear 13 is at the first rotational position (FIG. 9B), the first rib 20 and the first recessed portion 107 engage with each other, and the tubular member 101 is rotatable together with the gear 13 at the first position. In other words, in a case where the gear 13 is at the first rotational position, the first rib 20 is fitted in the first recessed portion 107, and the tubular member 101 is rotatable together with the gear 13 at the first position.

Further, in a case where the gear 13 is at the second rotational position (FIG. 10B), engagement between the first rib 20 and the first recessed portion 107 is released, so that rotation of the tubular member 101 is stopped at the second position. In other words, in a case where the gear 13 is at the second rotational position, the fitting of the first rib 20 in the first recessed portion 107 is released, so that rotation of the tubular member 101 is stopped at the second position.

As illustrated in FIG. 8A, the second recessed portion 108 is positioned at the other end portion 101B. The second recessed portion 108 is recessed from the other end portion 101B toward the one end portion 101A. A third rib 110 (described later, FIGS. 9B and 10B) of the gear cover 102 is configured to be inserted into the second recessed portion 108.

The third recessed portion 109 is positioned between the one end portion 101A and the other end portion 101B in the axial direction. The third recessed portion 109 is positioned at the outer surface of the tubular member 101, and is recessed in a direction from the other end portion 101B to the one end portion 101A in the axial direction. More specifically, the large diameter portion 104 has one end surface 104B in the axial direction. The one end surface 104B faces the protrusion 106 in the axial direction. The third recessed portion 109 is positioned at the large diameter portion 104. The third recessed portion 109 is recessed from the one end surface 104B of the large diameter portion 104 toward the outer surface 3A of the casing 3 in the axial direction (i.e., in the direction from the other end portion 101B to the one end portion 101A).

Figure 8B:
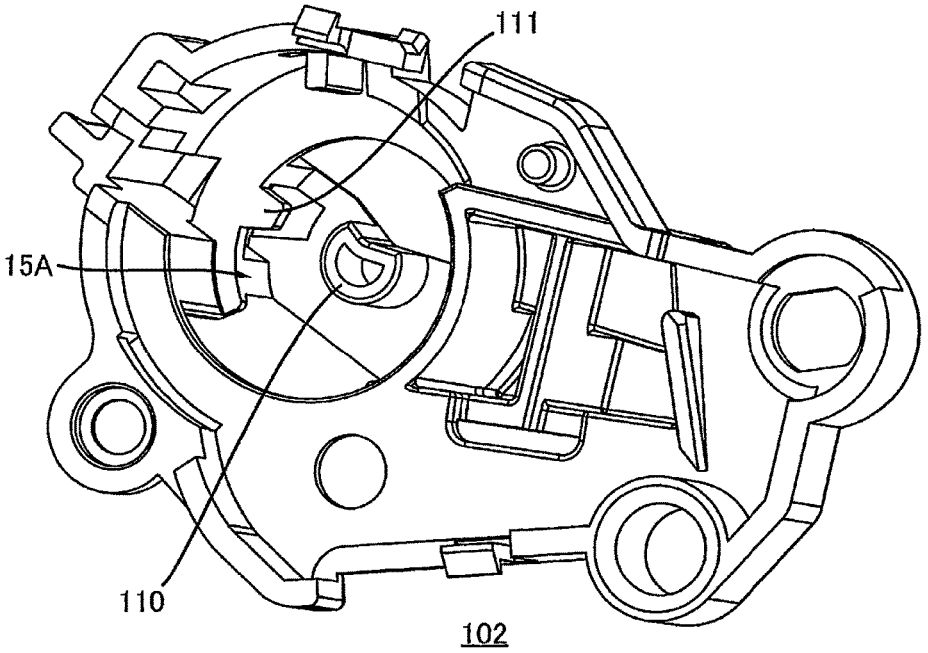
FIG. 8B is a perspective view of a gear cover illustrated in FIG. 7 in the developing cartridge according to the second embodiment, and illustrates an interior of the gear cover.

In a case where the gear 13 is at the second rotational position and the tubular member 101 is at the second position, the fourth rib 111 (described later) of the gear cover 102 engages with the third recessed portion 109 as illustrated in FIG. 8B. In other words, when the gear 13 is at the second rotational position and the tubular member 101 is at the second position, the fourth rib 111 (described later) of the gear cover 102 is fitted in the third recessed portion 109 as illustrated in FIG. 8B.

2. Gear Cover 102

As illustrated in FIGS. 7 and 9A, the gear cover 102 of the second embodiment is attached to the outer surface 3A, similarly to the gear cover 15 in the first embodiment. The gear cover 102 covers at least a portion of the gear 13 and the second gear 17.

Further, the gear cover 102 includes the third rib 110 and the fourth rib 111 as illustrated in FIGS. 7 and 8B.

The third rib 110 is configured to position the tubular member 101 at the second position in a case where the gear 13 is at the second rotational position. The third rib 110 extends from the side cover 24 of the gear cover 102 in the axial direction toward the outer surface 3A. As illustrated in FIG. 9B, the third rib 110 is configured to be inserted into the second recessed portion 108 of the tubular member 101. The third rib 110 is spaced away from an inner surface 108A of the second recessed portion 108 in the axial direction in a case where the gear 13 is at the first rotational position. The tubular member 101 is rotatable together with the gear 13 along the third rib 110 in a case where the gear 13 is at the first rotational position. On the other hand, the third rib 110 is in contact with the inner surface 108 in the axial direction in a case where the gear 13 is at the second rotational position. In other words, the third rib 110 engages with the second recessed portion 108 in a case where the gear 13 is at the second rotational position. Accordingly, the tubular member 101 is subjected to positioning at the second position.

The fourth rib 111 is configured to position the tubular member 101 at the first position in a case where the gear is at the first rotational position. The fourth rib 111 is positioned at an open end of the insertion hole 15A. The fourth rib 111 protrudes inwardly in a radial direction of the insertion hole 15A from the open end of the insertion hole 15A toward the third rib 110. In other words, the fourth rib 111 protrudes inwardly in the radial direction of the tubular member 101 from the open end of the insertion hole 15A toward the outer circumferential surface S3 (FIG. 8A) of the small diameter portion 105 of the tubular member 101.

In a case where the gear 13 is at the first rotational position, the fourth rib 111 is in contact with a portion of the outer surface of the tubular member 101 (FIG. 9B), thereby positioning the tubular member 101 at the first position. Incidentally, the fourth rib 111 is positioned between the one end portion 101A and the other end portion 101B in the axial direction in a case where the gear 13 is at the first rotational position.

On the other hand, in a case where the gear 13 is at the second rotational position, the fourth rib 111 is fitted in the third recessed portion 109 as illustrated in FIG. 8A. More specifically, the third recessed portion 109 has a sufficient depth (length in the axial direction) capable of allowing the tubular member 101 to move from the first position to the second position. In a case where the gear 13 rotates to reach the second rotational position, the third recessed portion 109 is brought into alignment with the fourth rib 111 in the axial direction, so that the fourth rib 111 can be relatively moved into the third recessed portion 109 by the urging force of the elastic member 114 described later (i.e., the fourth rib 111 can be received by the third recessed portion 109). In this way, the tubular member 101 is allowed to move from the first position to the second position (i.e., moved in a direction away from the outer surface 3A of the casing 3) in a case where the gear 13 is at the second rotational position.

3. Shaft 103

As illustrated in FIG. 7, the shaft 103 according to the second embodiment is positioned opposite to the coupling 4 (FIG. 1) with respect to the casing 3, similarly to the shaft 11 in the first embodiment. The shaft 103 extends in the axial direction. More specifically, the shaft 103 extends from the bearing 12. The shaft 103 is positioned at the outer surface 3A of the casing 3 as a result of attachment of the bearing 12 to the outer surface 3A. The shaft 103 is made from electrically conductive resin.

As illustrated in FIG. 9B, the shaft 103 is inserted into the through-hole 13A of the gear 13, and is inserted into the large diameter portion 104 of the tubular member 101. The shaft 103 extends through the gear 13, but does not extend through the tubular member 101. The shaft 103 is spaced away from the third rib 110 in the axial direction. The shaft 103 includes a large diameter portion 112 and a small diameter portion 113. The large diameter portion 112 has a hollow cylindrical shape. The large diameter portion 112 is inserted into the through-hole 13A. In a state where the large diameter portion 112 is inserted into the through-hole 13A, the large diameter portion 112 supports the gear 13. The small diameter portion 113 has a hollow cylindrical shape. The small diameter portion 113 is a portion to which the elastic member 114 (described later) is attached. The small diameter portion 113 has an outer diameter smaller than that of the large diameter portion 112.

4. Elastic Member 114

As illustrated in FIGS. 9B and 10B, the elastic member 114 of the second embodiment is positioned between the outer surface 3A and the tubular member 101 in the axial direction. Specifically, the elastic member 114 is positioned between the bearing 12 and the tubular member 101 in the axial direction. More specifically, the elastic member 114 is positioned between the large diameter portion 112 of the shaft 103 and the tubular member 101 in the axial direction. Further, the elastic member 114 covers a peripheral surface of the small diameter portion 113 of the shaft 103, and is positioned inside of the tubular member 101.

The elastic member 114 has electrical conductivity. More specifically, the elastic member 114 is a coil spring made from metal. The elastic member 114 extends in the axial direction, and has one end portion and another end portion in the axial direction. The other end portion of the elastic member 114 is spaced away from the one end portion of the elastic member 114. The one end portion of the elastic member 114 is in contact with the inner surface 104A of the tubular member 101 so that the elastic member 114 is electrically connected to the tubular member 101. More specifically, in a state where the gear 13 covers a peripheral surface of the tubular member 101 and a peripheral surface of the elastic member 114, the one end portion of the elastic member 114 is electrically connected to the tubular member 101. Incidentally, in the second embodiment, the one end portion of the elastic member 114 in the axial direction is directly electrically connected to the tubular member 101. However, the one end portion of the elastic member 114 may be electrically connected to the tubular member 101 through an intervening additional member.

The other end portion of the elastic member 114 is in contact with the large diameter portion 112 of the shaft 103. Thus, the elastic member 114 is electrically connected to the shaft 103. Since the elastic member 114 is electrically connected to the shaft 103, the bearing 12 is electrically connected to the elastic member 114 through the shaft 103. More specifically, in a state where the gear 13 covers the peripheral surface of the tubular member 101 and the peripheral surface of the elastic member 114, the other end portion of the elastic member 114 is electrically connected to the bearing 12. Incidentally, the other end portion of the elastic member 114 in the axial direction may be directly electrically connected to the bearing 12. Alternatively, the other end portion of the elastic member 114 may be electrically connected to the bearing 12 through an intervening additional member.

Since the elastic member 114 is electrically connected to the tubular member 101 and the bearing 12 is electrically connected to the elastic member 114, the developing roller shaft 2B is electrically connected to the elastic member 114 and the tubular member 101 through the bearing 12 and the shaft 103. Accordingly, in a case where the developing cartridge 1 is attached to the image forming apparatus and then the electrode of the image forming apparatus is brought into contact with the tubular member 101 that is exposed to the outside through the opening 15B (FIGS. 9A and 10A), developing bias is supplied to the developing roller shaft 2B from the electrode of the image forming apparatus by way of the tubular member 101, the elastic member 114, the shaft 103, and the bearing 12.

Further, in the state where the gear 13 covers the peripheral surface of the tubular member 101 and the peripheral surface of the elastic member 114, the one end portion of the elastic member 114 in the axial direction is electrically connected to the tubular member 101 and the other end portion of the elastic member 114 in the axial direction is electrically connected to the bearing 12. Thus, the developing roller shaft 2B can be electrically connected to the tubular member 101 through the elastic member 114 with realizing effective layout of the gear 13, the tubular member 101, and the elastic member 114. Accordingly, a size of the developing cartridge 100 in the axial direction can be reduced.

The elastic member 114 has a first state (FIG. 9B) and a second state (FIG. 10B). More specifically, the elastic member 114 is changeable between the first state (FIG. 9B) and the second state (FIG. 10B) by elastic deformation. The elastic member 114 in the first state has a first length L11 in the axial direction. The elastic member 114 in the second state has a second length L12 in the axial direction greater than the first length L11. An elastic force in the axial direction of the elastic member 114 in the first state is greater than an elastic force in the axial direction of the elastic member 114 in the second state. That is, the urging force of the elastic member 114 in the first state for urging the tubular member 101 is greater than the urging force of the elastic member 114 in the second state.

The tubular member 101 is at the first position in a case where the elastic member 114 is in the first state. Therefore, the tubular member 101 is urged toward the second position by the elastic member 114 in a case where the tubular member 101 is at the first position. Further, the tubular member 101 is at the second position in a case where the elastic member 114 is in the second state. Urging force of the elastic member 114 against the tubular member 101 is not necessarily required in a case where the tubular member is at the second position.

5. Operation in Developing Cartridge 100

Operation in the developing cartridge 100 will be described with reference to FIGS. 9B and 10B.

Upon attachment of the developing cartridge 100 to the image forming apparatus, the electrode provided at the lever is brought into contact with the tubular member 101 illustrated in FIG. 7 through the opening 15B of the gear cover 15. Therefore, developing bias can be applied to the tubular member 101 from the electrode of the image forming apparatus.

In a state where the developing cartridge 100 is attached to the image forming apparatus, in a case where the coupling 4 illustrated in FIG. 1 receives the driving force from the image forming apparatus, the gear 13 starts rotating from the first rotational position toward the second rotational position by the driving force received by the coupling 4.

Then, as illustrated in FIG. 9B, in a case where the tubular member 101 is at the first position, the tubular member 101 rotates together with the gear 13 since the gear 13 engages with the tubular member 101. Therefore, the protrusion 106 rotates together with the tubular member 101.

In a case where the protrusion 106 moves past the opening 15B, the protrusion 106 is brought into contact with the lever of the image forming apparatus to displace the lever, and the optical sensor detects the displacement of the lever. In this way, since the optical sensor detects the displacement of the lever, the image forming apparatus can retrieve information about the developing cartridge 1 on the basis of the displacement of the lever. For example, in a case where the image forming apparatus determines that the optical sensor detects the displacement of the lever, the image forming apparatus determines that the attached developing cartridge 1 is a new cartridge.

In this case, as illustrated in FIGS. 9A and 10A, the protrusion 106 moves to the inside of the gear cover 102, after the protrusion 106 passes through the opening 15B and goes out of the gear cover 102.

Then, as illustrated in FIG. 10B, the tubular member 101 is moved from the first position to the second position by the urging force of the elastic member 114 as a result of rotation of the gear 13 to the second rotational position after the protrusion 106 is moved into the gear cover 102.

Then, the rotation of the tubular member 101 is stopped because of the disengagement between the gear 13 and the tubular member 101.

Further, in a case where the tubular member 101 has already been positioned at the second position when the developing cartridge 100 is attached to the image forming apparatus, the tubular member 101 is not rotated even when the gear 13 is rotated by the driving force received by the coupling 4. More specifically, the optical sensor does not detect displacement of the lever. For example, in a case where the image forming apparatus determines that the optical sensor does not detect displacement of the lever, the image forming apparatus determines that the attached developing cartridge 100 is a used cartridge.

The developing cartridge 100 according to the second embodiment provides function and effect similar to those of the first embodiment.

<Modifications>

Several modifications will next be described. Engagement between the gear 13 and the tubular member 14 may be performed by a protrusion provided at the tubular member 14 and a recessed portion formed in the gear 13. In this case, the protrusion of the tubular member 14 is fitted in the recessed portion of the gear 13, thereby resulting in the engagement between the gear 13 and the tubular member 14.

Further, the gear 13 may include a friction portion instead of the plurality of gear teeth 18. In this case, the friction portion is configured to rotate the gear 13 by frictional force generated by the frictional contact with the second gear 17. Any kind of friction portion is available as long as the friction portion can generate frictional force by contacting the second gear 17. For example, the friction portion is made from rubber.

Further, instead of the direct meshing engagement between the gear 13 and the second gear 17, the gear 13 may be positioned away from the second gear 17 and an endless belt may be mounted between the gear 13 and the second gear 17. In the latter case, the gear 13 can be rotated by the rotation of the second gear 17 through a circular motion of the endless belt. Further, instead of the gear 13 and the second gear 17, pulleys having no gear teeth are available.

While the description has been made in detail with reference to specific embodiments and modifications, it would be apparent to those skilled in the art that various changes and modifications may be made thereto.

What is claimed is:

1. A developing cartridge comprising:

a casing configured to accommodate developing agent, the casing having an outer surface;

a developing roller rotatable about a first axis extending in an axial direction;

a shaft extending in the axial direction and positioned at the outer surface;

a tubular member rotatable about the shaft and covering a peripheral surface of the shaft, the tubular member being movable from a first position at which the tubular member is spaced away from the outer surface by a first distance to a second position at which the tubular member is spaced away from the outer surface by a second distance greater than the first distance, the tubular member including a protrusion extending along a portion of the peripheral surface of the shaft;

an elastic member positioned between the outer surface and the tubular member, the elastic member having a first state in which the elastic member has a first length in the axial direction and a second state in which the elastic member has a second length in the axial direction, the second length being greater than the first length, one end portion of the elastic member in the axial direction being in contact with the tubular member, wherein the tubular member is positioned at the first position in a case where the elastic member is in the first state, and the tubular member is positioned at the second position in a case where the elastic member is in the second state; and a gear covering a peripheral surface of the tubular member, the gear being rotatable about the shaft from a first rotational position to a second rotational position, wherein, in a case where the gear is at the first rotational position, the gear engages with the tubular member and the tubular member is rotatable together with the gear at the first position, and wherein, in a case where the gear is at the second rotational position, the engagement of the gear with the tubular member is released and the tubular member stops rotating at the second position.

2. The developing cartridge according to claim 1, wherein the gear has an inner circumferential surface covering the peripheral surface of the tubular member, wherein the gear includes a first rib extending in a radial direction of the gear from the inner circumferential surface toward the tubular member and the first rib extends along a portion of the inner circumferential surface, wherein the tubular member further includes a second rib extending in the radial direction of the gear from an outer circumferential surface of the tubular member toward the gear and the second rib extends along a portion of the outer circumferential surface, wherein, in a case where the gear is at the first rotational position, the first rib is in contact with the second rib and the tubular member is rotatable together with the gear at the first position, and wherein, in a case where the gear is at the second rotational position, the contact of the first rib with the second rib is released and the tubular member stops rotating at the second position.

3. The developing cartridge according to claim 2, further comprising a gear cover covering at least a portion of the gear, the gear cover being attached to the outer surface of the casing, wherein, in a case where the gear is at the first rotational position, the second rib is in contact with a portion of the gear cover, and wherein, in a case where the gear is at the second rotational position, the second rib is not in contact with the portion of the gear cover.

4. The developing cartridge according to claim 3, wherein the gear cover has an opening through which a portion of the tubular member is exposed, wherein, in a case where the gear is at the first rotational position, the shaft is exposed through the opening, wherein, in a case where the gear is at the second rotational position, the shaft is exposed through the opening, and wherein the protrusion moves past the opening during rotation of the gear from the first rotational position to the second rotational position.

5. The developing cartridge according to claim 1, wherein the gear has an inner circumferential surface covering the peripheral surface of the tubular member, wherein the gear includes a first rib extending in a radial direction of the gear from the inner circumferential surface toward the tubular member, the first rib extending along a portion of the inner circumferential surface, wherein the tubular member having one end portion and another end portion in the axial direction, the another end portion of the tubular member being farther from the outer surface than the one end portion of the tubular member is from the outer surface, wherein the tubular member further has a first recessed portion positioned at the one end portion of the tubular member, the recessed portion being recessed in a direction from the one end portion of the tubular member toward the another end portion of the tubular member, the first recessed portion being configured to engage with the first rib, wherein, in a case where the gear is at the first rotational position, the first recessed portion engages with the first rib and the tubular member is rotatable together with the gear at the first position, and wherein, in a case where the gear is at the second rotational position, the engagement of the first rib with the tubular member is released and the tubular member stops rotating at the second position.

6. The developing cartridge according to claim 5, further comprising a gear cover covering at least a portion of the gear, the gear cover being attached to the outer surface of the casing, the gear cover including a third rib extending toward the outer surface from the gear cover in the axial direction, wherein the tubular member has a second recessed portion positioned at the another end portion of the tubular member, the second recessed portion being recessed in a direction from the another end portion of the tubular member toward the one end portion of the tubular member, wherein the tubular member is rotatable together with the gear along the third rib in a case where the gear is at the first rotational position, and wherein the third rib engages with the second recessed portion in a case where the gear is at the second rotational position.

7. The developing cartridge according to claim 1, wherein the developing roller includes a developing roller shaft extending in the axial direction, wherein the protrusion extends from an outer surface of the tubular member, wherein the elastic member has electrical conductivity, wherein the tubular member is made from electrically conductive resin, and wherein the developing roller shaft is electrically connected to the elastic member and the tubular member.

8. The developing cartridge according to claim 7, further comprising a bearing supporting the developing roller shaft and made from electrically conductive resin, and wherein the developing roller shaft is electrically connected to the bearing, the bearing is electrically connected to the elastic member, and the elastic member is electrically connected to the tubular member.

9. The developing cartridge according to claim 7, further comprising a gear cover covering at least a portion of the gear, the gear cover being attached to the outer surface of the casing, the gear cover having an opening through which a portion of the tubular member is exposed, wherein, in a case where the gear is at the first rotational position, the tubular member is exposed through the opening, wherein, in a case where the gear is at the second rotational position, the tubular member is exposed through the opening, and wherein the protrusion moves past the opening during rotation of the gear from the first rotational position to the second rotational position.

10. The developing cartridge according to claim 1, wherein the shaft is electrically connected to the developing roller.

11. The developing cartridge according to claim 10, further comprising a gear cover covering at least a portion of the gear, the gear cover being attached to the outer surface of the casing, the gear cover having an opening through which a portion of the tubular member is exposed, wherein the protrusion is positioned opposite to the outer surface with respect to the tubular member, and is rotatable about the shaft together with the tubular member, wherein, in a case where the gear is at the first rotational position, the shaft is exposed through the opening, wherein, in a case where the gear is at the second rotational position, the shaft is exposed through the opening, and wherein the protrusion moves past the opening during rotation of the gear from the first rotational position to the second rotational position.

12. The developing cartridge according to claim 1, further comprising:

an agitator configured to agitate the developing agent accommodated in the casing, the agitator being rotatable about a second axis extending in the axial direction; and a second gear in meshing engagement with the gear, the second gear being mounted to the agitator and rotatable together with the agitator.

13. The developing cartridge according to claim 12, further comprising a coupling configured to receive driving force, the coupling being rotatable about a third axis extending in the axial direction, the coupling being positioned opposite to the gear with respect to the casing, wherein the gear and the second gear are rotatable according to the driving force received by the coupling.

14. The developing cartridge according to claim 1, further comprising a bearing, wherein the developing roller includes a developing roller shaft extending in the axial direction, the developing roller shaft being supported to the bearing, wherein, in a state where the gear covers both the peripheral surface of the tubular member and a peripheral surface of the elastic member, the one end portion of the elastic member in the axial direction is in contact with the tubular member, and wherein, in a state where the gear covers both the peripheral surface of the tubular member and the peripheral surface of the elastic member, another end portion of the elastic member in the axial direction is in contact with the bearing.

15. The developing cartridge according to claim 8, wherein, in a state where the gear covers both the peripheral surface of the tubular member and a peripheral surface of the elastic member, the one end portion of the elastic member in the axial direction is electrically connected to the tubular member, and wherein, in a state where the gear covers both the peripheral surface of the tubular member and the peripheral surface of the elastic member, another end portion of the elastic member in the axial direction is electrically connected to the bearing.

* * * * *